US005975203A

United States Patent [19]

Payne et al.

[11] Patent Number: 5,975,203

[45] Date of Patent: Nov. 2, 1999

[54] APPARATUS AND METHOD UTILIZING A COILED TUBING INJECTOR FOR REMOVING OR INSERTING JOINTED PIPE SECTIONS

[75] Inventors: Bryan K. Payne, Lafayette, La.; L. Michael McKee, Alvin; Michael L. Smith, Missouri City, both of Tex.

[73] Assignee: Schlumberger Technology Corporation, Houston, Tex.

[21] Appl. No.: 09/030,263

[22] Filed: Feb. 25, 1998

[51] Int. Cl.[6] ..... E21B 19/08; E21B 19/22

[52] U.S. Cl. ..... 166/77.3; 166/77.1; 166/77.2; 226/172; 254/372

[58] Field of Search ..... 166/77.1, 77.2, 166/77.3; 254/407, 372; 226/172, 173, 52

[56] References Cited

U.S. PATENT DOCUMENTS 3,285,485 11/1966 Slator ..... 226/172
4,655,291 4/1987 Cox ..... 166/385
5,775,417 7/1998 Council ..... 166/77.3
5,918,671 7/1999 Bridges et al. ..... 166/77.3

*Primary Examiner*—David Bagnell
*Assistant Examiner*—Chi H. Kang
*Attorney, Agent, or Firm*—Douglas Y'Barbo

[57] ABSTRACT

Apparatus and method for pulling or inserting jointed pipe sections (18) having upset ends (20) within a well utilizing a coiled tubing injector (26). The coiled tubing injector (26) has a pair of opposed endless chains (50, 52) including gripper blocks (58) for gripping the pipe sections (18). An axial gap (G) is provided in chains (50, 52) between adjacent gripper blocks (58) to receive the upset ends (20). To align accurately upset ends (20) with gap (G), a sensing mechanism (100, FIGS. 11 and 12) is provided to sense the location of upset end (20) and a sensing mechanism (110, 112, FIGS. 13 and 14) is provided to sense the location of gap (G). An operator in response to signals from the sensors accurately aligns upset ends (20) with gap (G).

25 Claims, 7 Drawing Sheets

FIG. 4
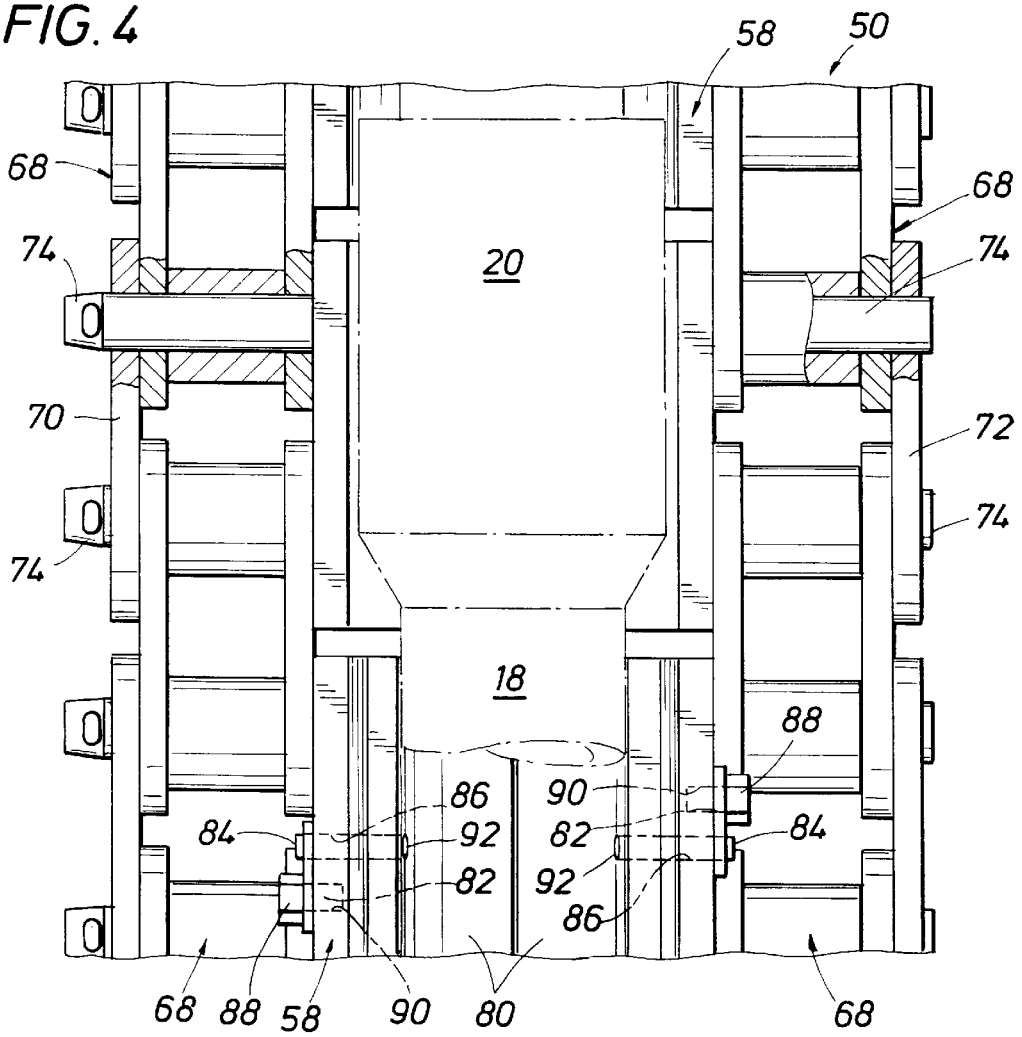
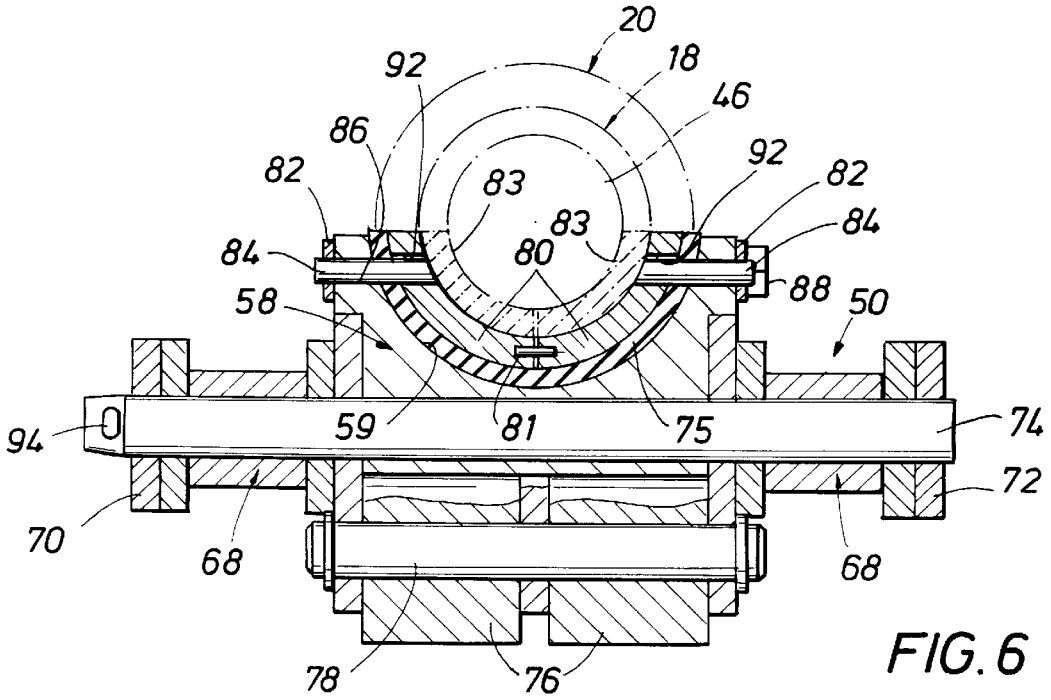
FIG. 6

APPARATUS AND METHOD UTILIZING A COILED TUBING INJECTOR FOR REMOVING OR INSERTING JOINTED PIPE SECTIONS

FIELD OF THE INVENTION

This invention relates generally to an apparatus and method utilizing a coiled tubing injector particularly adapted for removing or inserting jointed pipe sections having upset ends in a well.

BACKGROUND OF THE INVENTION

Workover operations are provided on existing production wells for various reasons. Several well workovers require a series of separate steps or tasks. Some of the steps may involve the insertion of coiled tubing (CT) downhole through the production tubing string, and then the lifting or pulling of the production tubing string. For example, it may be desired to raise the level of the producing zone one hundred (100) feet, for example, above the old producing zone and remove sand from the production tubing. For this purpose, coiled tubing (CT) is inserted within the production tubing by an injector for cleaning the sand from the tubing. Then the CT and CT injector are removed from the production tubing string. Next, a pipe pulling device or structure is mounted over the well for pulling or lifting the production tubing string to the desired height for raising the production zone. The upper end of the production tubing string after being raised is normally removed. Several types of pulling devices may be utilized with a coiled tubing injector as indicated below.

Drilling Rig and Standard Coiled Tubing Unit

The use of a drilling rig and a standard coiled tubing unit is not a standard practice for workover operations. However, the combination is possible and has application in some cases. The drilling rig is used to manipulate the jointed pipe while the coiled tubing unit runs the coiled tubing.

In this method the drilling rig manipulates the pipe in the wellbore to achieve the required task. Pipe which is removed from the well is either racked on the rig or laid down on the pipe rack. When continuous coiled tubing is needed the CT injector is moved on the rig floor and suspended from the traveling block of the rig. The coiled tubing system is then rigged up and the job performed. At the conclusion of the CT operation the injector is removed from the rig floor and rig operations proceed as needed. This exchange of equipment cycles back and forth until the planned intervention is completed.

Pulling Unit and Standard Coiled Tubing Unit

The use of the pulling unit and a standard coiled unit is a standard practice for workover operations. On jobs using a pulling unit and a standard coiled tubing unit, the pulling unit is used to manipulate the jointed pipe while the coiled tubing unit is used to run coiled tubing.

In this method using a large pulling unit, pipe is manipulated in the wellbore to achieve the required task by the pulling units. Pipe which is removed from the well is either racked on the rig or laid down on the pipe rack. When continuous coiled tubing is needed the CT injector is moved onto the rig floor and suspended from the traveling block of the pulling unit. The coiled tubing system is then rigged up and the job performed. At the conclusion of the CT operation the injector is removed from the rig floor and pulling unit operations proceed as needed. This exchange of equipment cycles back and forth until the planned intervention is completed.

For smaller pulling units, pipe which is removed from the well is laid down on the pipe rack. When continuous coiled tubing is needed the pulling unit is moved away from the well. The CT injector is moved over the wellhead and suspended from a crane. The coiled tubing system is then rigged up and the job performed. At the conclusion of the CT operation the injector is removed from the well and its pulling unit is moved back onto the well. This exchange of equipment cycles back and forth until the planned intervention is completed.

Snubbing Unit and Standard Coiled Tubing Unit

The use of a snubbing unit and a standard coiled tubing unit is a standard practice for workover operations. On jobs using a snubbing unit and a standard coiled unit, the snubbing unit is used to manipulate the jointed pipe while the coiled tubing unit is used to run coiled tubing.

In this method, pipe is manipulated in the wellbore to achieve the required task by the snubbing unit. The snubbing unit jacks pipe out or into the well with a series of short (5–15 feet) strokes. Pipe which is removed from the well is laid down on a pipe rack. When continuous coiled tubing is needed the CT injector is moved onto the rig floor and suspended from a crane. The coiled tubing system would then be rigged up and the job performed. At the conclusion of the CT operation the injector is removed from the rig floor and snubbing unit operations proceed as needed. This exchange of equipment cycles back and forth until the planned intervention is completed.

In many cases a snubbing unit rig up is very tall. In many cases the snubbing unit is moved away from the well and the CT unit is suspended over the wellhead with a crane to perform the job. At the conclusion of the CT operation the injector would be removed from the well and the snubbing unit would be moved back onto the well. This exchange of equipment would cycle back and forth until the planned intervention was completed.

Jack-up Frame and Standard Coiled Tubing Unit

The use of a jacking frame and a standard coiled tubing unit is a standard practice for workover operations. On jobs using a jacking frame and a standard coiled tubing unit, the jacking frame is used to manipulate the jointed pipe while the coiled tubing unit is used to run coiled tubing.

In this method, pipe is manipulated in the wellbore to achieve the required task by the jacking frame. The jacking frame jacks pipe out of or into the well with a series of short (5–10 foot) strokes. Pipe which is removed from the well is laid down on a pipe rack. When continuous coiled tubing is needed the CT injector is moved onto the jacking frame floor. The coiled tubing system is then rigged up and the job performed. At the conclusion of the CT operation the injector is removed from the floor and jacking frame operations would proceed as needed. This exchange of equipment cycles back and forth until the planned intervention is completed.

The limitation of all of these methods is that the coiled tubing injector must be rigged up and rigged down repeatedly to complete a job. This invention addresses this requirement and makes the operation more efficient. For the methods using a drilling rig, pulling unit or snubbing unit, a second contractor and additional assets are also required which make a project more difficult to manage and more expensive in terms of costs.

SUMMARY OF THE INVENTION

The present invention is directed particularly to a coiled tubing injector which is adapted to pull tubular connected pipe sections of a production tubing string from the well thereby eliminating the need for a separate pulling unit to pull a production tubing string from a well. The CT injector normally is supported on the upper end of a wellhead and injects or pushes a smooth continuous coiled tubing unreeled from a reel down the production tubing string.

The production tubing string on an existing production well is made up from a plurality of threaded pipe sections with each pipe section being around about thirty (30) feet in length. The length of a tubular pipe section is not always thirty (30) feet in length as a result of normal production operation, and oftentimes the length of a thirty (30) foot pipe section may vary one or two feet to provide a range as great as 28–32 feet. Thus, a precise pipe length cannot be relied upon. Each production pipe section has an upset end which has an increased wall thickness normally at each end of the pipe section to provide an increased outer diameter. Thus, any CT injector utilized for pulling or inserting production tubing must be adapted to receive and grip pipe sections having upset ends as opposed to smooth continuous coiled tubing.

A coiled tubing injector includes a tubing injector head having a gooseneck to receive the CT from a reel and a pair of spaced opposed endless chains receiving the coiled tubing therebetween. The endless chains comprise a plurality of connected links with each link having a gripper block therein including an inner semicircular sleeve or insert to contact and grip the outer peripheral surface of the CT to force the CT downwardly upon rotation of the opposed endless chains. A hydraulic motor drives the chains. The semicircular sleeve or insert normally includes a pair of removable quarter section inserts which are in contact with the coiled tubing. The quarter section inserts may be easily removed and replaced for handling coiled tubing of different outer diameters. The gripper blocks are arranged in end to end relation on the endless chains and are spaced from each other about ⅛ inch, thereby to grip the coiled tubing along substantially the entire outer surface of the smooth coiled tubing.

It is apparent that the present coiled tubing injectors having gripper blocks mounted on the endless chains could not be used to pull pipe having upset ends from the well as an enlarged diameter axial space between the chains is not provided to receive the upset ends of pipe since the upset ends are of a larger outside diameter than the remainder of the pipe.

The present invention is particularly directed to a coiled tubing injector and method in which the CT injector may be converted by providing an enlarged diameter axial space or gap in a pair of opposed chains sufficient to receive the upset end of a pipe section with the remaining length of the pipe section being engaged and gripped by gripper blocks for pulling the pipe section from the well. An axial spacing of about twelve (12) inches for the enlarged diameter axial space is adequate to receive the upset end or collar of a pipe section.

Coiled tubing normally has a diameter of 1½ inches or less while production tubing commonly has a diameter of about 2⅜ inches. Thus, the inserts in the gripper blocks for coiled tubing must be replaced with different size inserts for pulling or injecting production tubing. Additionally, a gap having an enlarged diameter axial space must be provided in the opposed chains to receive the upset ends of the production tubing. In one embodiment, the coiled tubing small radius inserts for the gripper blocks are replaced with larger radius inserts for the production tubing. In addition, inserts are entirely removed from about three opposed pairs of contiguous gripper blocks on opposed chains to provide a gap having an enlarged diameter axial space in the opposed chains for receiving the upset ends of the production tubing sections.

In another embodiment, the opposed chains for the coiled tubing are disconnected and replaced with a pair of opposed chains especially constructed for the production tubing with gripper blocks for gripping the production tubing and gaps in the chains formed by the absence of gripper blocks to provide the enlarged diameter axial space to receive the upset ends of the production tubing. In this embodiment, the original chains for the CT injector are removed and replacement chains are mounted on the injector having gripper blocks thereon with an axial gap or enlarged diameter spacing between a pair of axially spaced adjacent blocks to receive the upset end or collar of the pipe section. It is only necessary to provide a single gap or spacing for each chain as at least one complete revolution of a chain occurs for each pipe section.

Another feature of the invention includes a sensing device to detect the position of an upset end so that the upset end may be properly aligned with the gap in the opposed chains for being received therein.

An object of this invention is to provide a coiled tubing injector which is effective to pull a pipe string having a plurality of connected pipe sections with upset ends from a well and to inject the pipe string within the well.

A further object of the invention is the provision of a method for converting a coiled tubing injector for pushing coiled tubing within a well into a CT injector and for pulling a jointed pipe section having an upset end from the well.

Another object of the invention is the provision of an apparatus and method effective both to insert coiled tubing in a well and to pull jointed pipe sections from the well without removal of the apparatus from the well.

An additional object of the invention is the provision of a sensing mechanism for a coiled tubing injector to sense the position of an upset end on a pipe section for aligning the upset end with a gap in the chain drive for receiving the upset end in the gap.

Other objects, features, and advantages of the present invention will be apparent from the following specification and drawings.

BRIEF DESCRIPTION OF THE DRAWINGS

FIG. 4 is a plan view of a portion of an endless chain showing the gripper blocks carried by the chain with a large diameter insert mounted on one gripper block and inserts removed from a pair of adjacent gripper blocks to form an enlarged diameter space or gap to receive an upset end of a tubing string section shown therein;

FIG. 6 is a sectional view taken generally along line 6—6 of FIG. 5;

DESCRIPTION OF THE INVENTION

Figure 1:
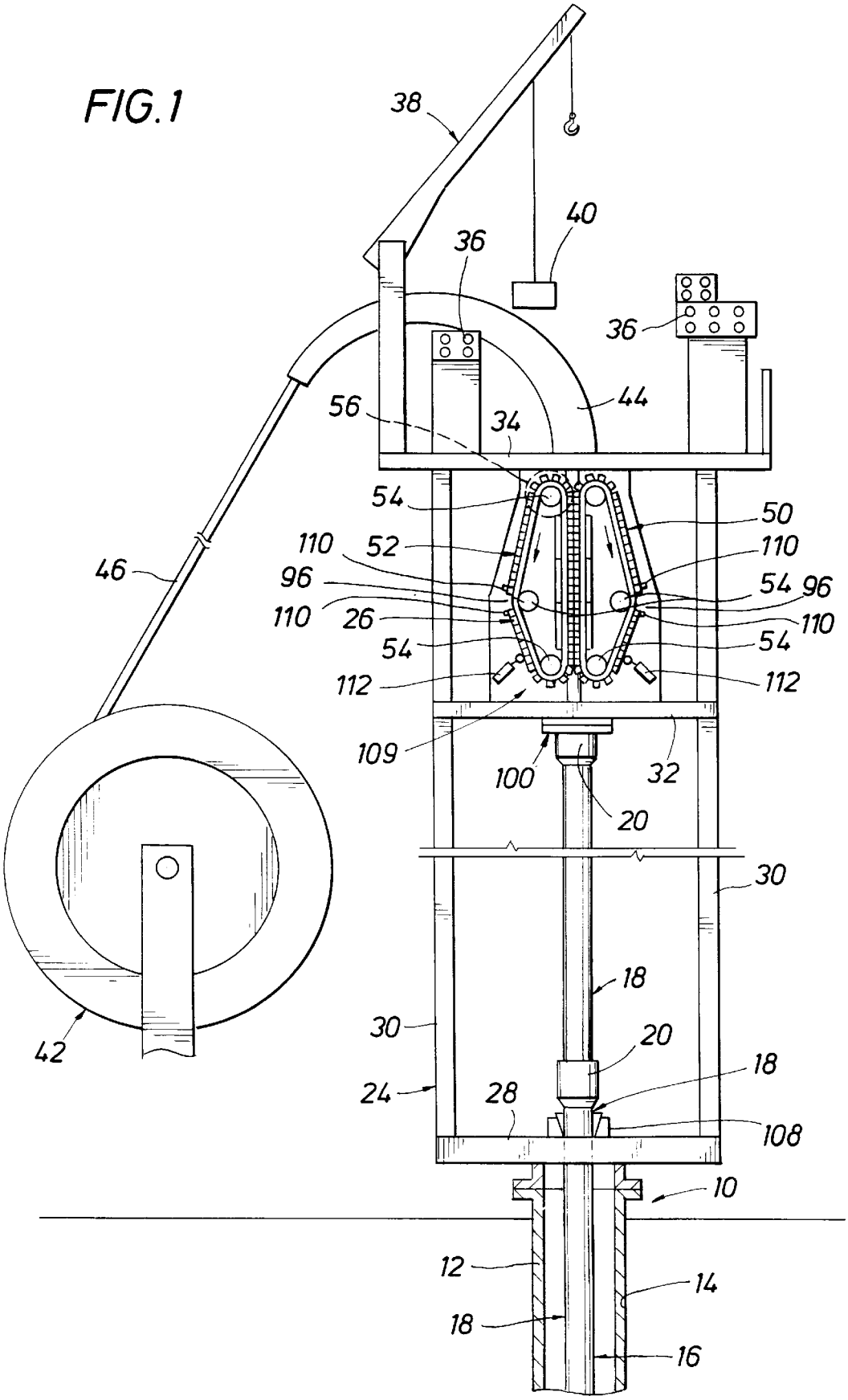
FIG. 1 is an elevational view, partly schematic, of a coiled tubing injector positioned for pulling a tubing string from a well and showing the injector positioned over a wellhead for the well.
Figure 3:
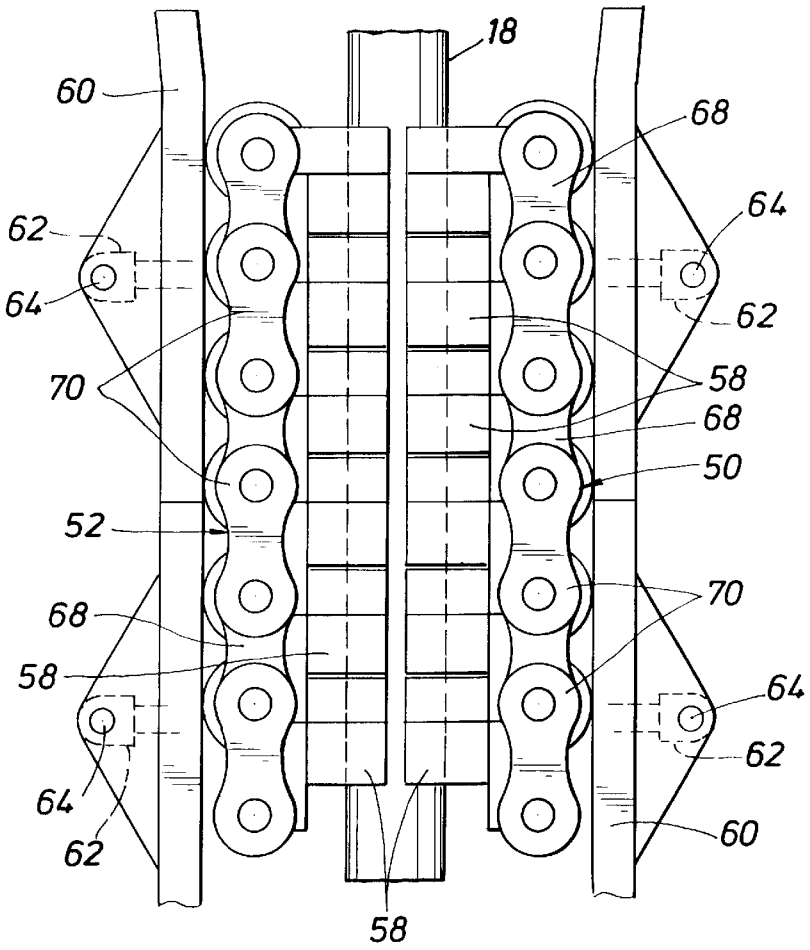
FIG. 3 is an enlarged elevational view of the portion of the endless chain shown in FIG. 2 and showing a pair of opposed endless chains for gripping a tubular member therebetween.

Referring now to the drawings for a better understanding of this invention, reference is made to FIG. 1 in which the coiled tubing injector forming an important part of this invention is shown mounted on an apparatus over a wellhead shown generally at 10. Wellhead 10 is mounted on the upper end of an outer casing string 12 in a bore hole 14 of a well. The well has been completed for production and a production tubing string is shown generally at 16. Production tubing string 16 includes a plurality of jointed pipe sections 18 each being of a length of about thirty (30) feet. Each pipe section 18 has an upper upset end or collar 20 of an increased wall thickness and being internally threaded to receive in threaded relation an externally threaded small diameter end portion of a superjacent pipe section 18. Upset end 20 may, for example, be of a length about nine (9) inches and of an outer diameter of about 2⅞ inches. Wellhead 10 is provided at the upper end of the casing string 12.

A vertically extending frame generally indicated at 24 is mounted over wellhead 10 to support a coiled tubing (CT) injector generally indicated at 26. Frame 24 has a lower base 28 supported on wellhead 10 and vertical frame members 30 extend upward therefrom to an intermediate horizontal platform 32 for CT injector 26. An upper platform or work stand 34 supported by frame 24 has a control panel 36 mounted thereon and an operator on platform 34 monitors panel 36 and controls the operation of CT injector 26. A suitable hoist 38 over upper platform 34 is provided for removing an upset pipe section 18 from tubing string 16 when pulled from the well by CT injector 26. Tongs 40 are provided for making and breaking the threaded pipe connections. Coiled tubing injector 26 is a conventional CT injector for injecting coiled tubing within a well and for removing coiled tubing from the well. A satisfactory coiled tubing injector, for example, may be purchased from Bowen Tools, Inc., Houston, Tex.; Stewart and Stevenson, Houston, Tex.; Dyer Equipment, Inc., Calgary, Canada; or Hydra-Rig, Inc. of Ft. Worth, Tex.

Figure 2:
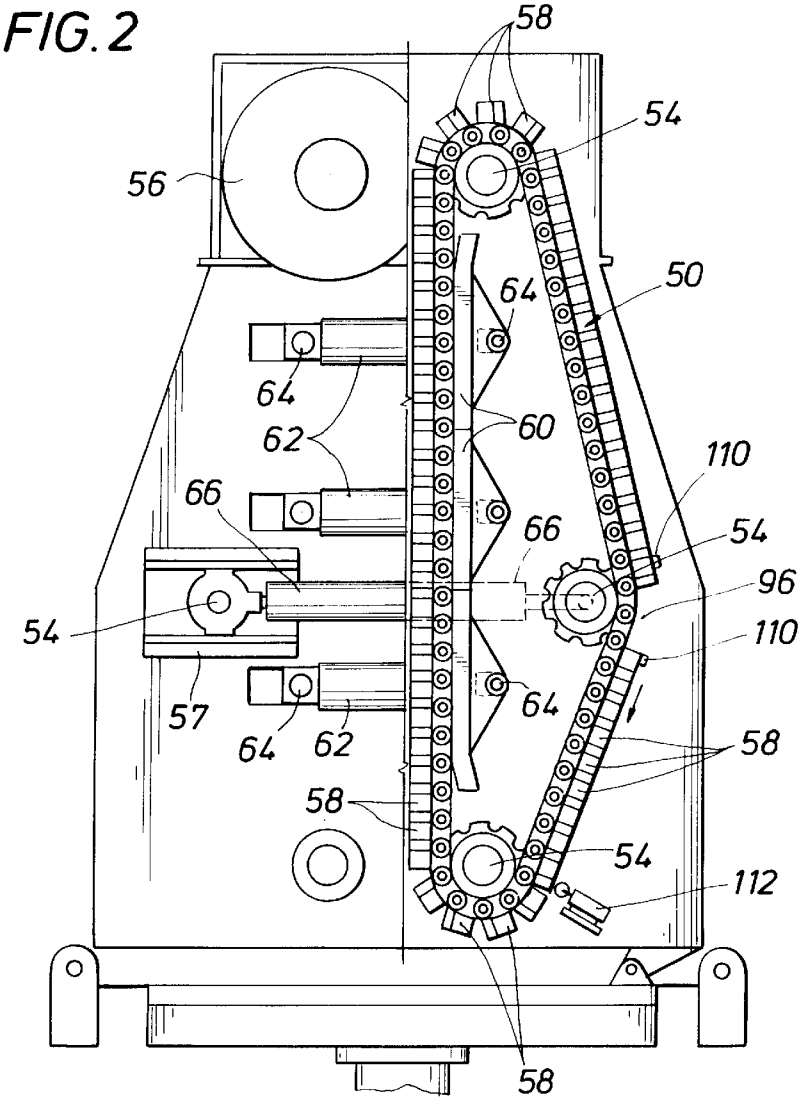
FIG. 2 is a side elevational view of an endless chain of the injector shown in FIG. 1 and showing gripper blocks on the endless chain for gripping a pipe section or coiled tubing.
Figure 5:
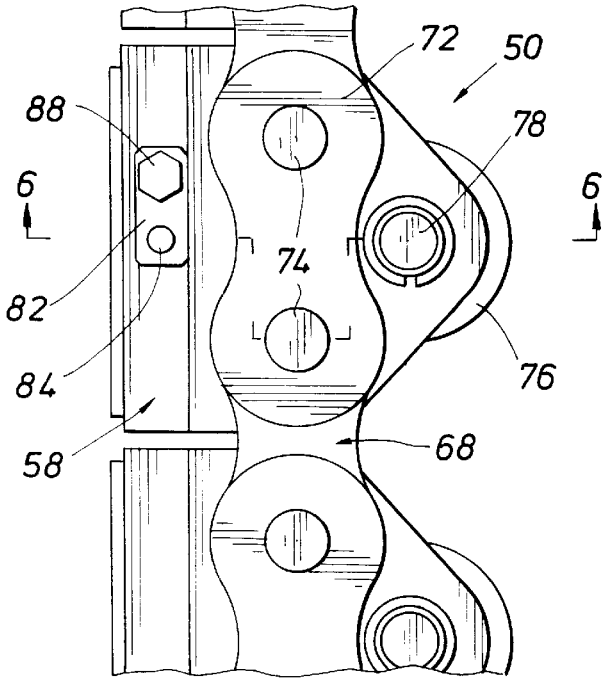
FIG. 5 is an enlarged side elevational view of a portion of the endless chain.
Figure 7:
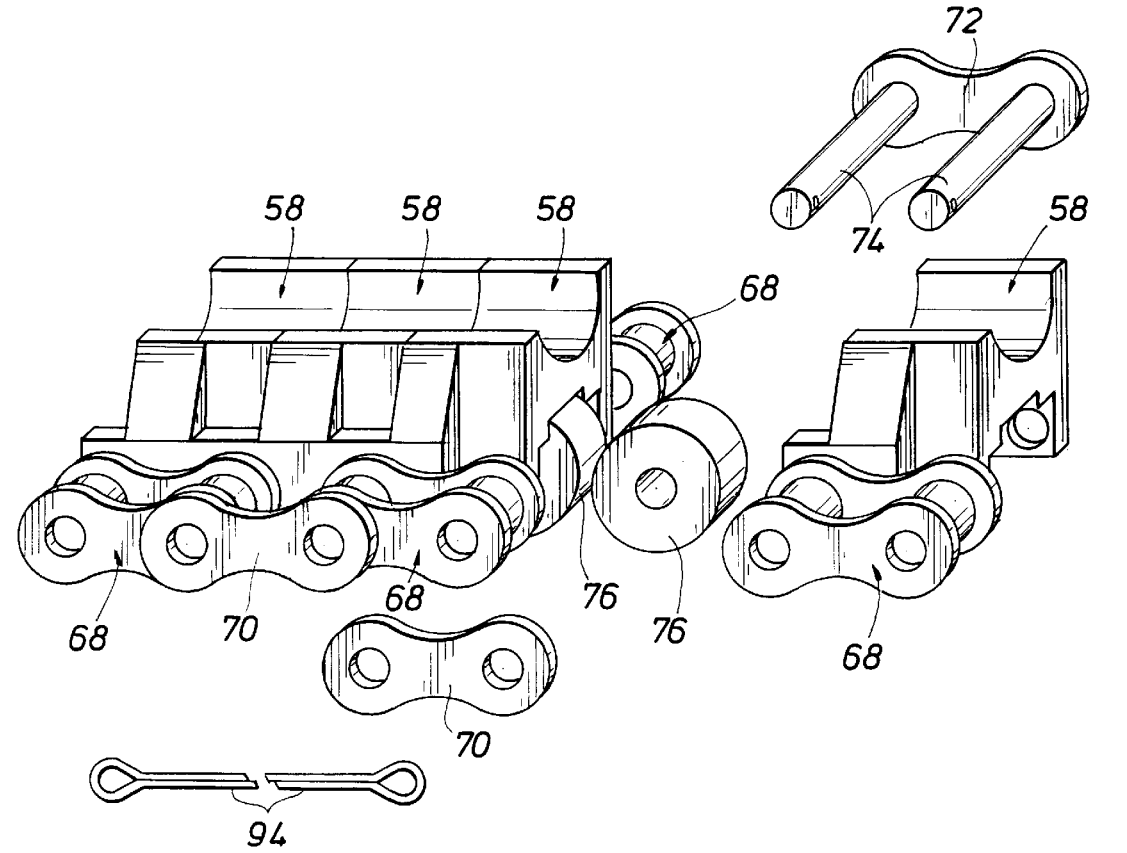
FIG. 7 is an exploded view of an endless chain and illustrating disconnection of the endless chain.

A coiled tubing reel 42 supplies a coiled tubing string 46 to a gooseneck 44 which directs the coiled tubing downwardly into the injector head of injector 26 when coiled tubing 46 is injected within the well. When withdrawn from the well, the coiled tubing is directed upwardly from the well onto reel 42 upon a reversal of the movement of injector 26 as well known. CT injector 26 has a pair of opposed endless chains 50, 52 mounted on sprockets 54. Upper sprockets 54 are driven by reversible hydraulic motor 56 and suitable gearing for rotating both endless chains 50 and 52 simultaneously as shown also in FIG. 2. Each chain 50, 52 has a plurality of gripper blocks 58 mounted thereon for tightly gripping coiled tubing 46. Each gripper block 58 has an inner semicircular cavity 59 as shown in FIG. 6 to receive the coiled tubing 46. Bars 60 engage chains 50, 52. Cylinders 62 have opposed piston rods extending therefrom and connected to pivots 64 for bars 60. Cylinders 62 urge pivots 64 and bars 60 toward each other for exerting force against coiled tubing 46. Intermediate sprockets 54 are mounted within slides 57 for sliding movement. Cylinder 66 urges intermediate sprockets 54 away from each other for tensioning chains 50, 52 a predetermined amount. Gripper blocks 58 extend continuously along chains 50, 52 and are spaced from each other about ⅛ inch. Chains 50 and 52 are generally similar but rotate in opposed directions. Each chain 50, 52 may, for example, have a total length of about fifteen (15) feet and have thirty six (36) gripper blocks 58 thereon, each block 58 being of a length of about five (5) inches.

Referring to FIGS. 4–7, a typical portion of chain 50 is shown having links 68 connected by link plates 70 and 72. Link plate 72 has a pair of link pins 74. Gripper block 58 has a pair of rollers 76 mounted on axle 78 for rotation. Connecting link plate 72 is effective to connect link plate 70 to links 68 when pins 74 are secured within the aligned openings in links 68 and link plate 70. Cotter pins 94 in link pins 74 retain link pins 74 in position. CT injector 26 as described above is particularly adapted for the insertion of coiled tubing within a production tubing string within a well.

As shown particularly in FIG. 6, gripper block 58 has a semicircular concave cavity 59 with an elastomeric liner 75 therein of a relatively small thickness, such as ⅛ inch for example. For coiled tubing, a pair of removable quarter section inserts 83 shown in broken lines are mounted in cavity 59 in contact with liner 75 thereby to provide a small diameter space to received coiled tubing 18 in gripping relation. Connecting links 82 having pins 84 are inserted within openings 86 in block 58 and suitable openings in inserts 83 to hold inserts 83 in position. Mounting bolts 88 are threaded within aligned openings 90 in links 82 and gripping block 58 to secure links 82 to block 58.

Figure 8:
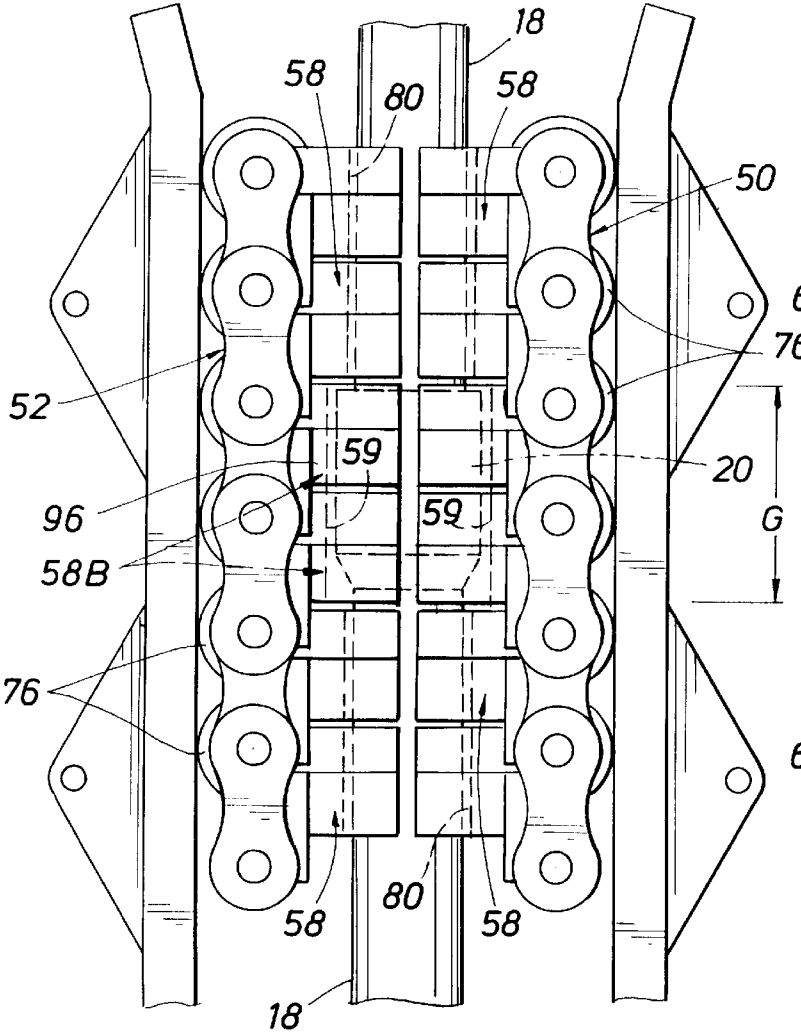
FIG. 8 is an enlarged elevational view similar to FIG. 3 but showing an axial gap of an enlarged diameter space formed by removal of inserts from selected gripper blocks carried by the endless chains to receive an enlarged diameter upset end of a pipe section.

If desired to adapt gripping blocks 58 to receive jointed pipe sections 18 of production tubing string 16, the relatively small radius quarter inserts 83 are removed by removal of bolts 88 and removal of links 82 with pins 84 thereon. Then, quarter inserts 80 of a radius larger than the radius of inserts 83 are positioned with gripping blocks 58 in contact with elastomeric liner 75 and connected by pin 81. Next, links 82 with pins 84 are inserted within openings 86 in blocks 58 and aligned openings 92 in inserts 80 to hold inserts 80 in position. Bolts 88 are received within openings in links 82 and then threaded within internally threaded openings 90 of blocks 58 to hold inserts 80 in position for gripping the larger diameter tubing string section 18. Production tubing string 16 includes a plurality of pipe sections 18 having upset ends 20. Upset ends 20 are of a greater outside diameter, such as about 2⅞ inches, than the remainder of the pipe section 18 and will not pass through injector 26 even with the large radius inserts 80. Thus, injector 26 must be modified or converted so that endless chains 50 and 52 can receive upset ends 20. For this purpose, inserts 83 along with liner 75 are removed from selected adjacent blocks 58 so that the semicircular cavities 59 are empty to receive upset end 20 as shown particularly in FIG. 4. The arcuate surfaces of cavities 59 do not normally contact the upset end 20 received therein. As shown particularly in FIG. 8, an axial gap G of an enlarged diameter is provided by blocks 58 B which have all inserts removed thereby to provide an enlarged space to receive upset end 20 of tubing string section 18. The inserts of two or three pairs of contiguous blocks 58 are normally removed to form gap G. Thus, axial gap G is provided between axially spaced gripping blocks 58 and has an enlarged diameter space to receive upset end 20. The enlarged diameter space of gap G may be formed by various means including removal of gripping blocks in order to receive enlarged diameter upset end 20. Upset end 20 is normally not engaged by adjacent gripping blocks.

It is necessary to align upset end 20 with gap G as associated pipe section 18 moves upwardly within CT injector 26. For this purpose, sensors are provided to indicate the position of gap G and the position of upset end 20. Then, an operator can adjust endless chains 50, 52 and coordinate the upward movement of pipe section 18 so that upset end 20 is received within gap G. It is noted that pipe sections 18 do not always have a precise length but may, for example, vary in length over one (1) foot. Thus, sensors are required for accurate alignment of upset end 20 with gap G.

Sensing Mechanism for Unset Pipe

Figure 10:
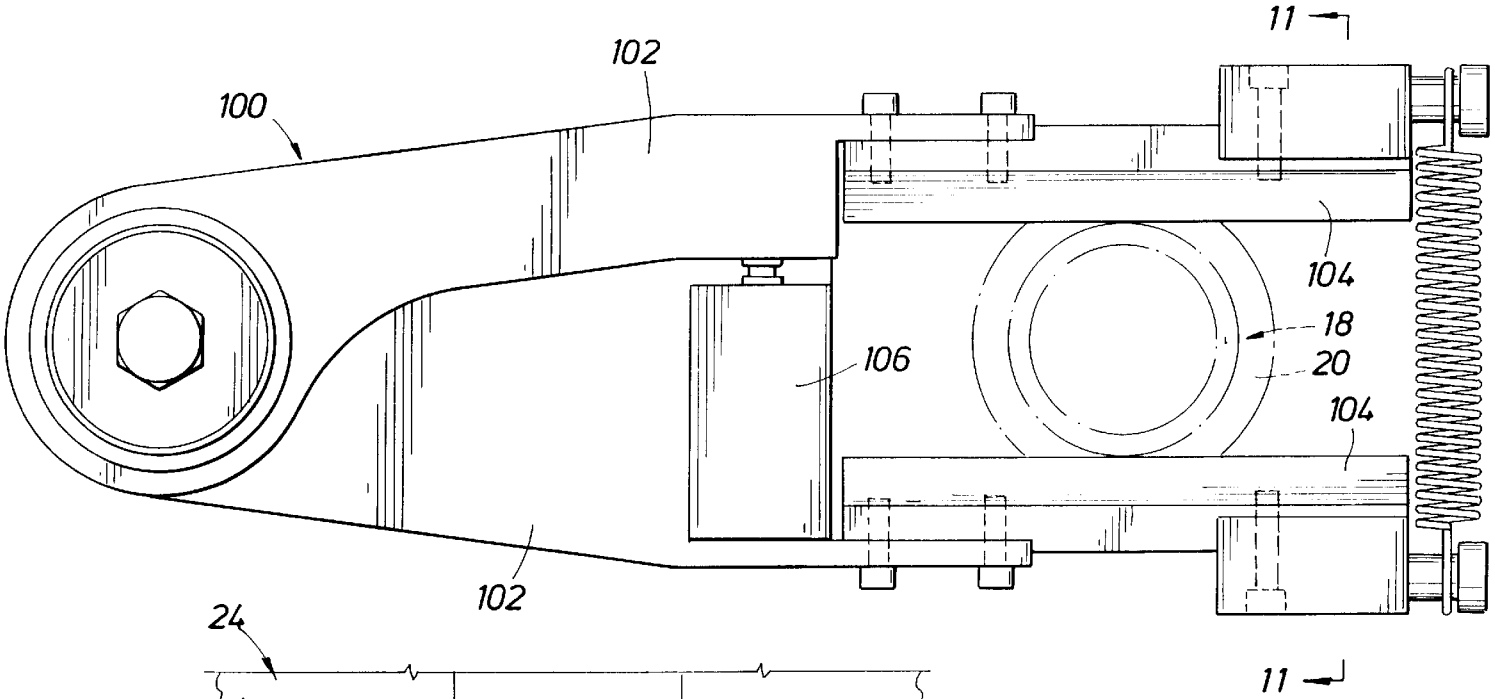
FIG. 10 is an elevational view of a sensing mechanism for sensing the position of the enlarged diameter upset end of a pipe section.
Figure 11:
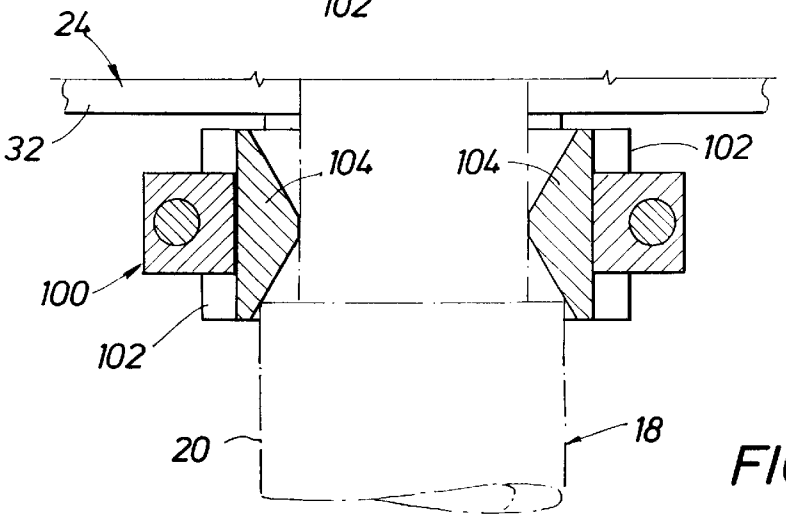
FIG. 11 is a section taken generally along the line 11—11 of FIG. 10.

For sensing the location of upset end 20, a pipe sensing mechanism shown generally at 100 is mounted on frame 24 beneath CT injector 26 as shown particularly in FIGS. 10 and 11. A pair of pivotally connected arms 102 have cam blocks 104 therein. Upset end 20 on pipe section 18 contacts cam blocks 104 to cam arms 102 outwardly for activating a limit switch 106. Activation of limit switch 106 sends a signal to control panel 36 which is viewed by the operator. If desired, a second limit switch may be utilized to indicate when upset end 20 is close to the desired position. Slips 108 adjacent wellhead 10 are then actuated by the operator to grip the lower end portion of pipe section 18 for positioning pipe section 18 at a precise position.

Sensing Mechanism for Chain Gap

Figure 12:
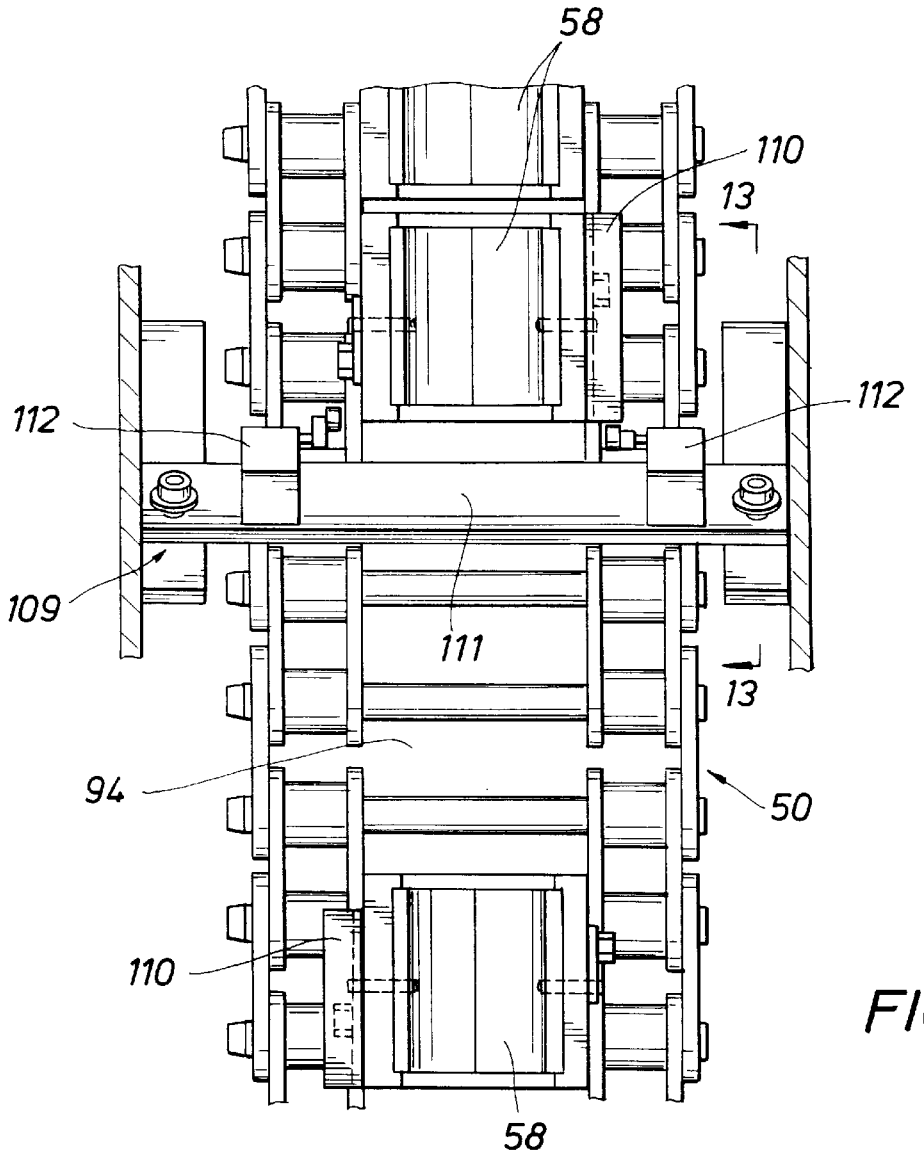
FIG. 12 is an elevational view showing the sensing mechanism for sensing the position of the gap in the endless chain for receiving the enlarged diameter upset end of the pipe section and including limit switches.
Figure 13:
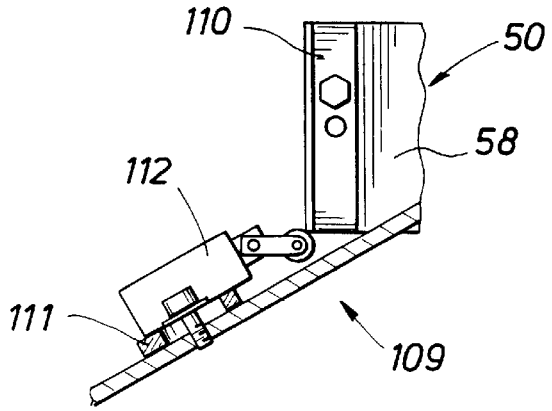
FIG. 13 is a side elevational view of the sensing mechanism taken along line 13—13 of FIG. 12 and illustrating an extending tab on the endless chain for contacting the limit switch.

To locate the position of gap G, a sensing mechanism as shown in FIGS. 12 and 13 is positioned on the injector frame 109 adjacent the lower end of chain 50 or chain 52 including limit switches 112 mounted on opposed sides of chain 50 or chain 52 on a support bar 111. An outwardly extending tab 110 is mounted on selected gripper blocks 58 generally adjacent gap G. Tabs 110 contact limit switches 112 mounted on the injector frame 109 adjacent the lower ends of endless chains 50, 52. A signal is provided to control panel 36 upon actuation of limit switches 112 to indicate to the operator the location of gap G in chains 50 and 52. One tab 110 is effective to provide a signal to the operator when chains 50, 52 are close to the desired position and the other tab 110 is effective to provide a signal at the precise desired position. The chains 50 and 52, upon a release of tension, are then rotated to a precise position as indicated by a tab 110 contacting a limit switch 112 and then stopped. The operator at control panel 36 is aware of the precise location at which gap G is positioned in order to receive upset end 20 of pipe section 18 to be removed.

Operation

In operation for removal of a production tubing string 16 from a well, a lift joint assembly including a production tubing section and a connecting coupling is first run through injector 26. The lift joint assembly including the production tubing section is then lowered until the upset end of the tubing section is close to the top of injector 26. Then, the chains 50 and 52 are rotated upon release of the gripping force for aligning gap G visually with the upset end. When the joint is located at gap G, a gripping force is reapplied to chains 50 and 52. Then, the lift joint assembly is lowered through CT injector 26 below sensing mechanism 100. Next, the lift joint assembly is lifted until sensed by sensing mechanism 100. Upon lifting of the production tubing string 16 and contact of upset end 20 of an upper pipe section against cam blocks 102, limit switch 106 is actuated. The operator stops injector 26 and then applies slips 108 to grip tightly pipe section 18 and prevent further upward movement of pipe section 18. In this position, the upset end 20 and gap G in the chains remain timed with each other. Tabs 110 are mounted on blocks 58 such that limit switches 112 are actuated. This determines the location of gap G in chains 50 and 52 for receiving upset end 20 accurately. Then, the slips 108 are released from the pipe section 18. The lift joint assembly is lowered further and threadedly connected to the tubing string in the well. Next, the upper production tubing section 18 is lifted by injector 26 to a desired height where upset end 20 is positioned above injector 26 and upper platform 34. Then, tongs 40 are operated by the operator to engage and unthread the upper production tubing section 18 from the remainder of tubing string 16.

The present invention can also be utilized for running or inserting production tubing within the well. The pipe sensing or detecting mechanism is not utilized when running pipe within the bore hole. The upset end 20 is visible from the rig floor and the alignment of upset end 20 with gap G can be timed when the connection of the pipe joint is being made up. The top of the pipe joint is located a precise distance above the rig floor and slips 108 are set. The next pipe section is then added. The gripping force from chains 50, 52 is then released and chains 50, 52 are rotated to a position determined by limit switches 112 which are different from the position of limit switches 112 utilized for the removal of a tubing string. In this position, upset end 20 and gap G are accurately positioned for alignment. The gripping force is then reapplied prior to disengagement of slips 108 and upset end 20 is received within gap G. This procedure is repeated for inserting additional upset tubing sections.

Figure 9:
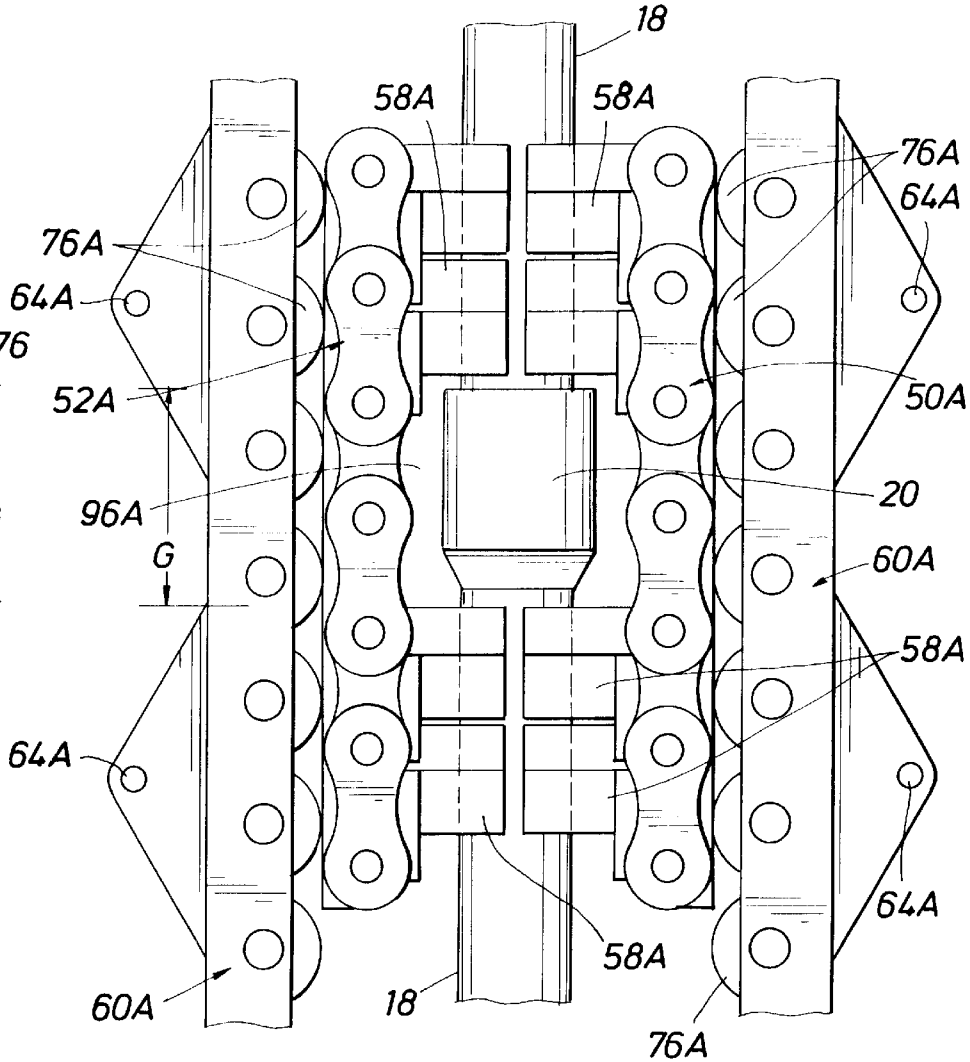
FIG. 9 is an elevational view similar to FIG. 8 but showing a modified chain arrangement in which the endless chains are mounted about a pair of end sprockets only and showing a gap formed by the absence of gripper blocks to provide a large diameter space in the opposed chains to receive an upset end.

Embodiment of FIG. 9

With certain designs of endless chains and gripper blocks such as shown in the modification of FIG. 9, replacement endless chains 50A and 52A are mounted about a pair of end sprockets without any intermediate sprockets. The original chains for the CT injector have been previously removed and replaced with chains 50A and 50B which have selected gripper blocks 58A removed to form gap G to adapt chains 50A and 52A to receive a production tubing string. Rollers 76A are mounted on tension bars 60A urged by hydraulic cylinders (not shown) connected to bars 60A at 64A into contact with chains 50A and 52A. Gripper blocks 58A are mounted on chains 50A and 52A in a manner similar to the embodiment shown in FIGS. 2–8. Thus, the embodiment shown in FIG. 9 is constructed for injecting or pulling pipe sections 18 having upset ends 20. Gripper blocks 58A are similar to gripper blocks 58.

From the foregoing, a coiled tubing injector has been provided effective for insertion and removal of a production tubing string formed of connected pipe sections having upset ends in addition to the insertion and removal of smooth coiled tubing. Opposed endless chains having gripper blocks provide a gap of an enlarged diameter space between adjacent axially spaced gripper blocks to receive the upset end. While a gap between adjacent gripper blocks has been illustrated for jointed production tubing having upset ends, such an arrangement could be used with pipe sections having smooth joints or with smooth coiled tubing even though the gap would not be utilized to receive an enlarged diameter pipe portion.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A coiled tubing injector for pulling a jointed pipe section having an upset end from a well; said coiled tubing injector comprising:

a pair of opposed endless chains each having a plurality of gripper blocks thereon for gripping said pipe section, a pair of adjacent gripper blocks on each chain being spaced longitudinally from each other an axial distance at least equal to the length of said upset end to form a gap of an enlarged diameter space in said chains to receive said upset end; and drive means for rotating said endless chains to pull said pipe section from said well.

2. A coiled tubing injector as set forth in claim 1 wherein:

sensing means are provided to sense the position of said gap in said chains; and means responsive to said sensing means effective to align said gap with said upset end for pulling of said pipe section from the well by said chains with said upset end received within said gap.

3. A coiled tubing injector as set forth in claim 2 wherein sensing means are provided to sense the position of said upset end of the pipe section to be pulled; and means responsive to said sensing means for said gap and said sensing means for said upset end for alignment of said gap and said upset end for pulling of said pipe section from the well by said chains.

4. A coiled tubing injector as set forth in claim 3 wherein said sensing means to sense the position of said upset end comprises a limit switch actuated by movement of said pipe section; and slips are actuated to grip said pipe section in response to actuation of said limit switch.

5. A coiled tubing injector as set forth in claim 2 wherein said sensing means to sense the position of said gap comprises a limit switch actuated by movement of said endless chains to indicate the position of said chains and said gap.

6. A coiled tubing injector as set forth in claim 1 wherein removable arcuate inserts are positioned in said gripper blocks for contacting said pipe section; said arcuate inserts being removed from selected adjacent gripper blocks to form said gap of an enlarged diameter space for receiving said upset end.

7. A coiled tubing injector as set forth in claim 1 wherein:

chain tensioning means are provided to urge said gripper blocks into tight gripping relation with said pipe section; said tensioning means being released to permit movement of said chains relative to said pipe section for accurate alignment of said upset end with said gap.

8. A coiled tubing injector for injecting coiled tubing downhole within a well comprising:

a pair of opposed endless chains having gripper blocks thereon for receiving coiled tubing in gripping relation therebetween;

drive means for rotating said endless chains for pushing coiled tubing downwardly within a production tubing string formed from a series of connected jointed pipe sections having upset ends; and means for converting said endless chains for injecting coiled tubing to endless chains for pulling said jointed pipe sections from the well; said means including an axial gap in said chains of an enlarged diameter and of a length sufficient to receive an upset end of a jointed pipe section so that the endless chains pull a jointed pipe section having an upset end upwardly from the well.

9. A coiled tubing injector as set forth in claim 8 wherein removable arcuate inserts of a relatively small radius are positioned in said gripper blocks for contacting said coiled tubing; and additional removable arcuate inserts of a relatively large radius are positioned in said gripper blocks for contacting said production tubing string upon removal of said small radius arcuate inserts.

10. A coiled tubing injector as set forth in claim 9 wherein said removable arcuate inserts are removed from selected adjacent gripper blocks to form said gap of an enlarged diameter space to receive an upset end of a jointed pipe section.

11. A coiled tubing injector as set forth in claim 8 wherein said endless chains for inserting and pulling coiled tubing are converted to chains for inserting and pulling jointed pipe sections by removal of a selected number of adjacent gripper blocks to create said axial gap of an enlarged diameter space.

12. A coiled tubing string injector as set forth in claim 8 wherein:

sensing means are provided to sense the position of said gap in said chains and to sense the position of the upset end of the pipe section to be pulled; and means responsive to said sensing means are effective to align said gap with said upset end for pulling of said pipe section from the well by said chains with said upset end received within said gap.

13. A method for pulling a jointed pipe section having an upset end from a well with a coiled tubing injector for normally injecting coiled tubing; said method comprising the following steps:

providing a pair of opposed endless chains each having a plurality of gripper blocks thereon for gripping said pipe section;

providing an axial gap having an enlarged diameter portion in each endless chain of a length at least equal to the length of said upset end of said pipe section;

aligning said upset end of said pipe section with said gap for receiving said upset end within said gap; and rotating said endless chains with said gripper blocks tightly gripping said pipe section for pulling said pipe section upwardly from said well.

14. A method for pulling a jointed pipe section having an upset end from a well as set forth in claim 13 including the steps of:

sensing the position of said upset end on said jointed pipe section;

sensing the position of said gap on said endless chains; and coordinating the movement of said endless chains and the movement of said pipe section in response to sensing the position of said gap and the position of said pipe section so that said upset end is received accurately within said gap.

15. A method for pulling a jointed pipe section having an upset end from a well as set forth in claim 14 including the steps of:

providing sensors for sensing the position of said upset end and the position of said gap in said endless chains;

releasing the gripping force of said endless chains and gripper blocks against a pipe section when the position of an upset end on a subjacent connected pipe section is sensed;

rotating said endless chains with the gripping force released to a predetermined position;

then reapplying the gripping force against said endless chains and gripper blocks against a pipe section; and rotating said endless chains after reapplying said gripping force with the upset end of said subadjacent pipe section being received within said gap on said endless chains.

16. A method for converting a coiled tubing injector from pushing smooth coiled tubing downhole within a production tubing string in a well to pulling jointed pipe sections having upset ends of the production tubing string upwardly from the well, the coiled tubing injector having a pair of opposed endless chains thereon with each chain having a plurality of gripper blocks thereon extending continuously without interruption for receiving coiled tubing in gripping relation therebetween; said method comprising:

forming an axial gap in said opposed chains of an enlarged diameter and having a length at least equal to the length of an upset end of a pipe section to be pulled;

positioning said upset end of said pipe section within said gap with gripper blocks in gripping contact with said pipe section; and rotating said chains for pulling of said pipe section upwardly from the well.

17. The method of converting a coiled tubing injector as set forth in claim 16 including the step of:

removing selected adjacent gripper blocks from said opposed chains for forming said gap in said chains.

18. The method of converting a coiled tubing injector as set forth in claim 16 including the steps of:

providing said gripper blocks with removable arcuate inserts for contacting said coiled tubing and for contacting said pipe section; and removing said inserts from selected adjacent gripping blocks to form said axial gap in said opposed chains to receive an upset end of said pipe section.

19. The method for converting a coiled tubing injector as set forth in claim 16 including the steps of:

sensing the position of said upset end on said jointed pipe section;

sensing the position of said gap in said endless chains; and coordinating the movement of said endless chains and the movement of said pipe section in response to sensing the position of said gap and the position of said pipe section so that said upset end is received accurately within said gap.

20. The method for converting a coiled tubing injector as set forth in claim 16 including the steps of:

providing sensors for sensing the position of said upset end and the position of said gap in the gripper blocks of said endless chains;

releasing the gripping force of said endless chains and gripper blocks against a pipe section when the position of an upset end on a subjacent connected pipe section is sensed;

rotating said endless chains with the gripping force released to a predetermined position;

then reapplying gripping force against said endless chains and gripper blocks against a pipe section; and rotating said endless chains after reapplying said gripping force with the upset end of said subadjacent pipe section being received within said gap on said endless chains.

21. Apparatus over a wellhead with a production tubing string therein for pushing coiled tubing downhole within the production tubing string and for pulling jointed pipe sections of the tubing string upwardly from the wellhead, the jointed pipe sections having upset ends; said apparatus comprising:

a vertically extending frame mounted over the wellhead and extending upwardly therefrom, a coiled tubing injector mounted on said frame to push coiled tubing downwardly within the production tubing string and to pull the coiled tubing upwardly for removing the coiled tubing from the production tubing string;

said coiled tubing injector including a pair of opposed endless chains having a plurality of gripper blocks thereon for receiving the coiled tubing in gripping relation therebetween for pushing or pulling said coiled tubing; said plurality of gripper blocks having an axial gap of an enlarged diameter between a pair of adjacent blocks of a length at least equal to the length of an upset end on said jointed pipe sections;

said coiled tubing injector being selectively arranged and constructed to receive the upset end of a pipe section in said gap with the gripper blocks gripping a portion of the length of said pipe section for pulling the pipe section from the well; and a control panel for an operator to control the operation of said coiled tubing injector.

22. Apparatus as set forth in claim 21 wherein:

first sensing means are provided for sensing the position of the gap in said gripper blocks;

second sensing means are provided for sensing the position of the upset end of the pipe section to be pulled upwardly; and means responsive to said first and second sensing means to provide alignment of said upset end with said gap so that said upset end is received within said gap.

23. Apparatus as set forth in claim 22 wherein said means responsive to said first and second sensing means include slips actuated to stop the axial movement of the pipe section; and means to release the gripping force from said endless chains to permit relative movement of said endless chains to a predetermined position for receiving said upset end in said gap.

24. Apparatus over a wellhead with a production tubing string therein for pushing coiled tubing downhole within the production tubing string and for selectively inserting jointed pipe sections of the tubing string downwardly within the wellhead, the jointed pipe sections having upset ends; said apparatus comprising:

a vertically extending frame mounted over the wellhead and extending upwardly therefrom;

a coiled tubing injector mounted on said frame for inserting jointed pipe sections of the production tubing string within the well;

said coiled tubing injector including a pair of opposed endless chains having a plurality of gripper blocks thereon for receiving the jointed pipe sections in gripping relation therebetween, said plurality of gripper blocks having an axial gap of an enlarged diameter between a pair of adjacent blocks of a length at least equal to the length of an upset end on said jointed pipe sections;

said coiled tubing injector being arranged and constructed to receive the upset end of the pipe section in said gap between a pair of gripper blocks with the gripper blocks gripping a portion of the length of said pipe section for inserting the pipe section within the well; and a control panel for an operator to control the operation of said coiled tubing injector.

25. Apparatus as set forth in claim 24 wherein:

sensing means are provided for sensing the position of said gap in said gripper blocks and providing a signal to said control panel for said operator.

* * * * *